US008870009B2

(12) United States Patent
Heiman

(10) Patent No.: US 8,870,009 B2
(45) Date of Patent: Oct. 28, 2014

(54) CONTAINERS PARTICULARLY FOR AGRICULTURAL PRODUCTS

(76) Inventor: Yosef Heiman, Karmey Yosef (IL)

( * ) Notice: Subject to any disclaimer, the term of this patent is extended or adjusted under 35 U.S.C. 154(b) by 678 days.

(21) Appl. No.: 12/682,888

(22) PCT Filed: Oct. 29, 2008

(86) PCT No.: PCT/IB2008/002877
§ 371 (c)(1),
(2), (4) Date: Jul. 19, 2010

(87) PCT Pub. No.: WO2009/050581
PCT Pub. Date: Apr. 23, 2009

(65) Prior Publication Data

US 2010/0308041 A1 Dec. 9, 2010

(30) Foreign Application Priority Data

Oct. 16, 2007 (IL) ..... 186685

(51) Int. Cl.
*B65D 25/16* (2006.01)

(52) U.S. Cl.
USPC ..... 220/9.4; 220/9.2; 220/9.1

(58) Field of Classification Search
CPC ..... B65D 33/00; B65D 33/02
USPC ..... 220/9.4, 9.2, 9.1, 668; 383/119, 104, 383/109
See application file for complete search history.

(56) References Cited

U.S. PATENT DOCUMENTS

| | | | | |
|---|---|---|---|---|
| 579,030 | A * | 3/1897 | Yerby | 220/9.1 |
| 2,724,537 | A * | 11/1955 | Fehr | 220/9.1 |
| 4,795,350 | A * | 1/1989 | Rubio | 434/159 |
| 6,561,372 | B1 * | 5/2003 | Connolly | 220/9.1 |
| 6,601,723 | B1 * | 8/2003 | Ziglar | 220/4.34 |
| 6,997,338 | B2 * | 2/2006 | Sabounjian | 220/9.4 |
| 7,204,183 | B2 * | 4/2007 | Cirillo | 86/50 |
| 2003/0168453 | A1 | 9/2003 | Sabounjian | |
| 2005/0223881 | A1 | 10/2005 | Cirillo | |

FOREIGN PATENT DOCUMENTS

| | | | |
|---|---|---|---|
| CA | 1231901 | A1 | 1/1988 |
| FR | 1090693 | A | 4/1955 |
| GB | 868791 | A | 5/1961 |
| GB | 914720 | A | 1/1963 |

OTHER PUBLICATIONS

English-Language Translation of Office Action issued by the State Intellectual Property Office of the People's Republic of China dated Dec. 13, 2011 in co-pending Chinese Application No. 200880111605.5.8.

(Continued)

*Primary Examiner* — Stephen Castellano
(74) *Attorney, Agent, or Firm* — The Law Office of Michael E. Kondoudis

(57) ABSTRACT

An open top container comprising a rectangular frame having four frame-members ($H_1$;$H_2$;$H_3$;$H_4$) and four legs ($G_1$;$G_2$;$G_3$;$G_4$) extending from the four corners of the frame. A first sleeve ($S_1$) made of a foldable sheet material is wrapped over a first pair of opposite frame-members, and a second sleeve ($S_2$) made of a foldable sheet material is wrapped over a second pair of opposite frame-members.

8 Claims, 6 Drawing Sheets

(56) References Cited

OTHER PUBLICATIONS

English-Language Translation of Office Action issued by the State Intellectual Property Office of the People's Republic of China dated Nov. 22, 2012 in co-pending Chinese Application No. 200880111606.5.

Office Action issued by the Canadian Intellectual Property Office dated Mar. 24, 2014 in parallel Canadian Application No. 2,702,840.

Office Action issued by the Mexican Institute of Industrial Property dated Feb. 19, 2013 in parallel Mexican Application No. MX/a/2010/004023.

* cited by examiner

CONTAINERS PARTICULARLY FOR AGRICULTURAL PRODUCTS

This is a non-provisional application claiming the benefit of International application number PCT/IB2008/002877 filed Oct. 29, 2008.

FIELD OF THE INVENTION

The present invention relates to containers, particularly for the storage and/or shipping of agricultural products such as vegetables and fruits.

BACKGROUND OF THE INVENTION

Conventional containers of the type referred to mainly fall into three categories: pulp-based corrugated cardboard; extruded synthetic corrugated boards mainly of to polypropylene ("P.P.") or PVC; and injected plastic crates, whether foldable or solid.

Each one of the above listed categories possesses its particular advantages and drawbacks.

It is thus the general object of the invention to provide a container and method for the construction thereof that will overcome most of the shortcomings of the is conventional containers and in particular; cheaper to produce; more space saving; less harmful to the environment; easy to erect and disassemble; less sensitive to humidity; rinseable; suitable for shipment of chilled/frozen products; conveniently reusable and/or recycled; and readily stackable for palletizing.

Among the additional, outstanding and unique advantages of the novel containers, there should be mentioned their ability to display the merchandise to the ultimate consumers (e.g. in the marketplace); aesthetical appearance; easily printable logos and or other sales promotion inscriptions in full color spectrum; as well as other features that will become apparent from the description below.

SUMMARY OF THE INVENTION

Provided according to one general aspect of the invention is a method of producing open top containers in particular for storing and/or shipping of agricultural products comprising the steps of providing a rigid structure comprised of a rectangular frame comprised of at least four frame-members and four legs extending from the four corners of the frame; wrapping the rigid structure by a first sleeve made of foldable sheet material so that the sleeve envelopes a first pair of opposite frame members; and wrapping the rigid structure by a second sleeve made of a foldable sheet material so that the sleeve envelopes the second pair of opposite frame members.

According to another aspect of the invention there is provided an open top container in particular for storing and/or shipping of agricultural products, comprising a rigid structure comprised of a rectangular frame comprised of at least four frame-members and four legs extending from the four corners of the frame; a first sleeve made of a foldable sheet material wrapped over a first pair of opposite frame-members; and a second sleeve made of a foldable sheet material wrapped over a second pair of opposite frame-members.

BRIEF DESCRIPTION OF THE DRAWINGS

These and additional constructional features and advantages of the present invention will become more readily understood in the light of the ensuing description of preferred embodiments thereof, given by way of example only, with reference to the accompanying drawings, wherein:—

DETAILED DESCRIPTION OF THE PREFERRED EMBODIMENTS

Figure 1A:
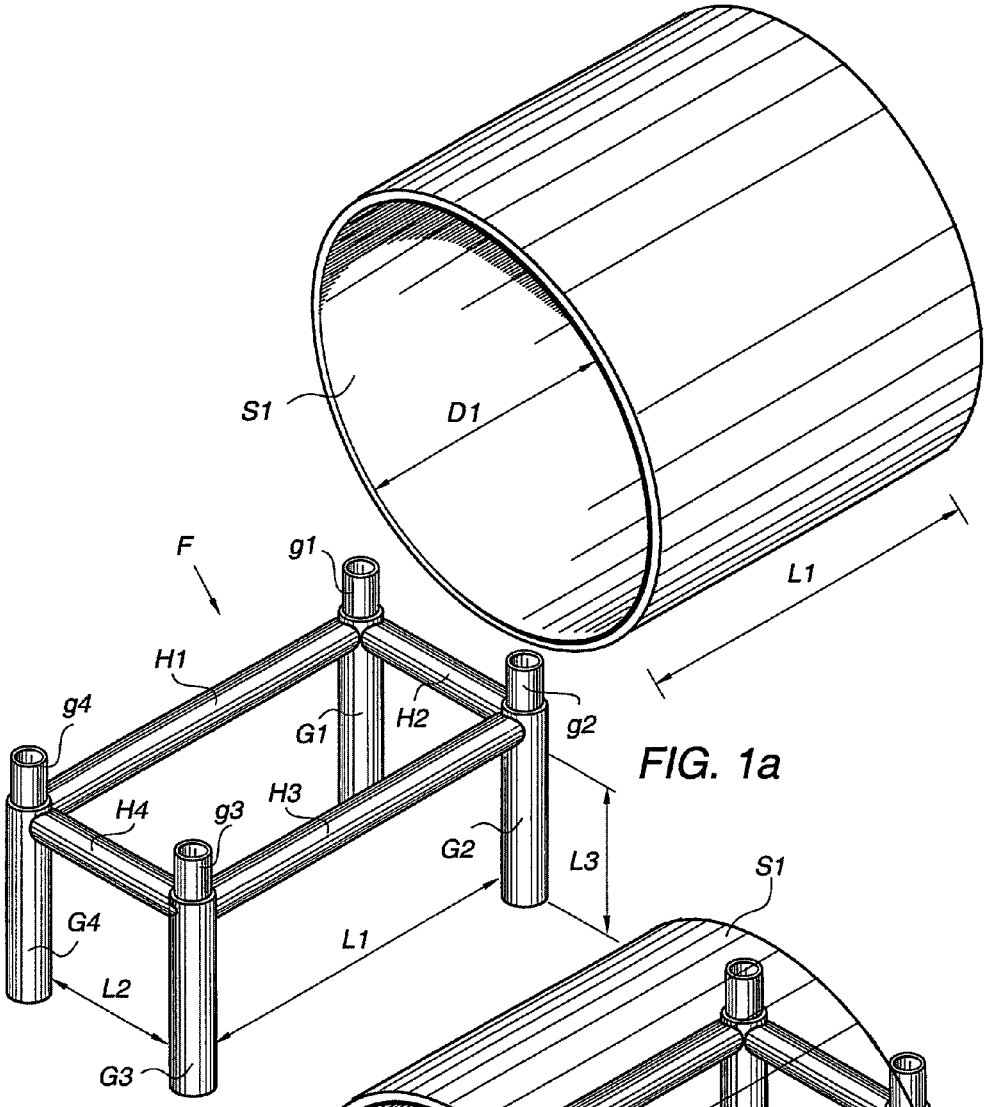
FIG. 1*a* illustrates a first, preparatory stage of the method for assembling a container according to a preferred embodiment of the present invention.
Figure 2A:
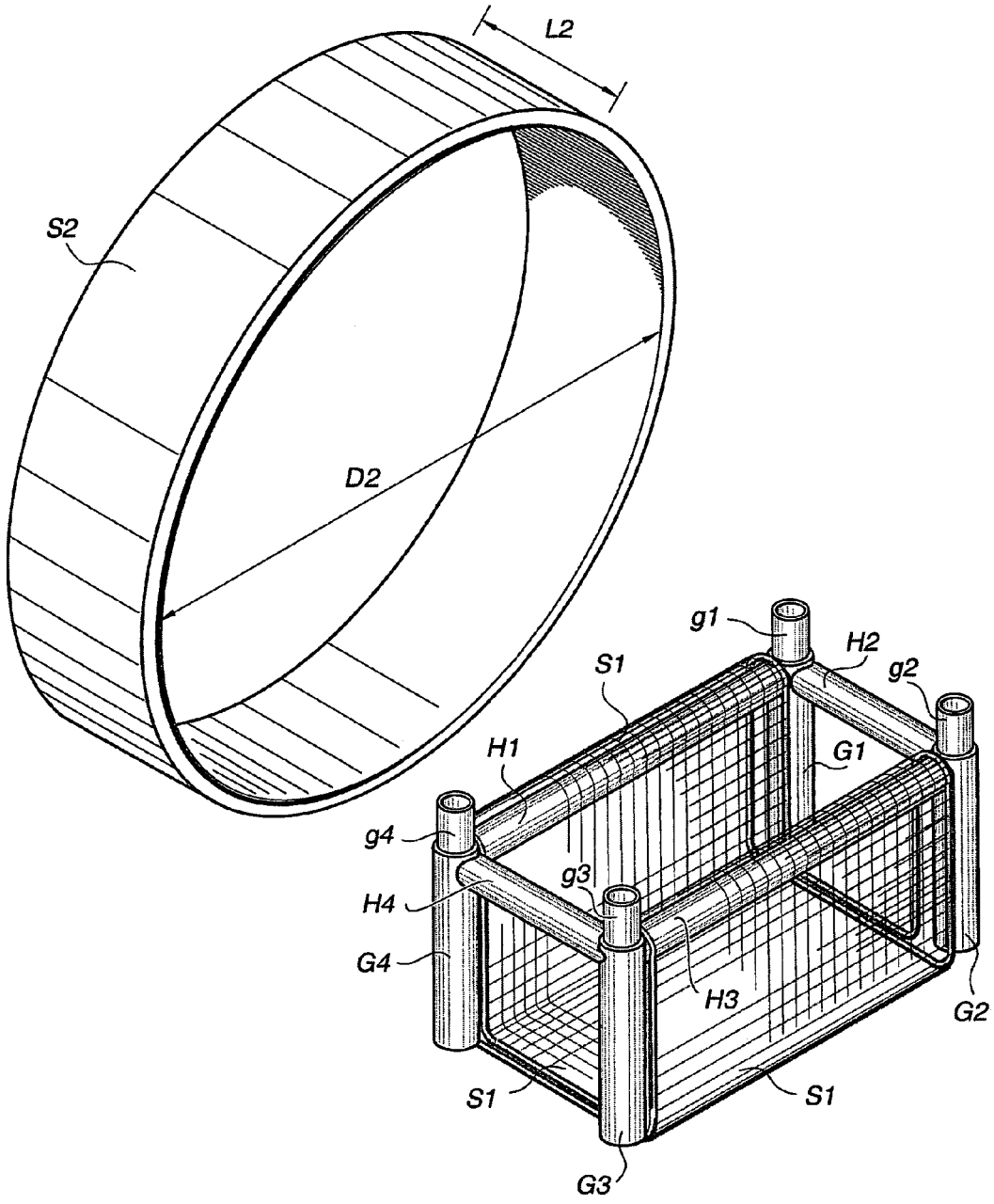
FIGS. 2*a*-2*d* are similar to F*igs*. 1*a*-1*e* but with respect to a second sleeve.
Figure 2B:
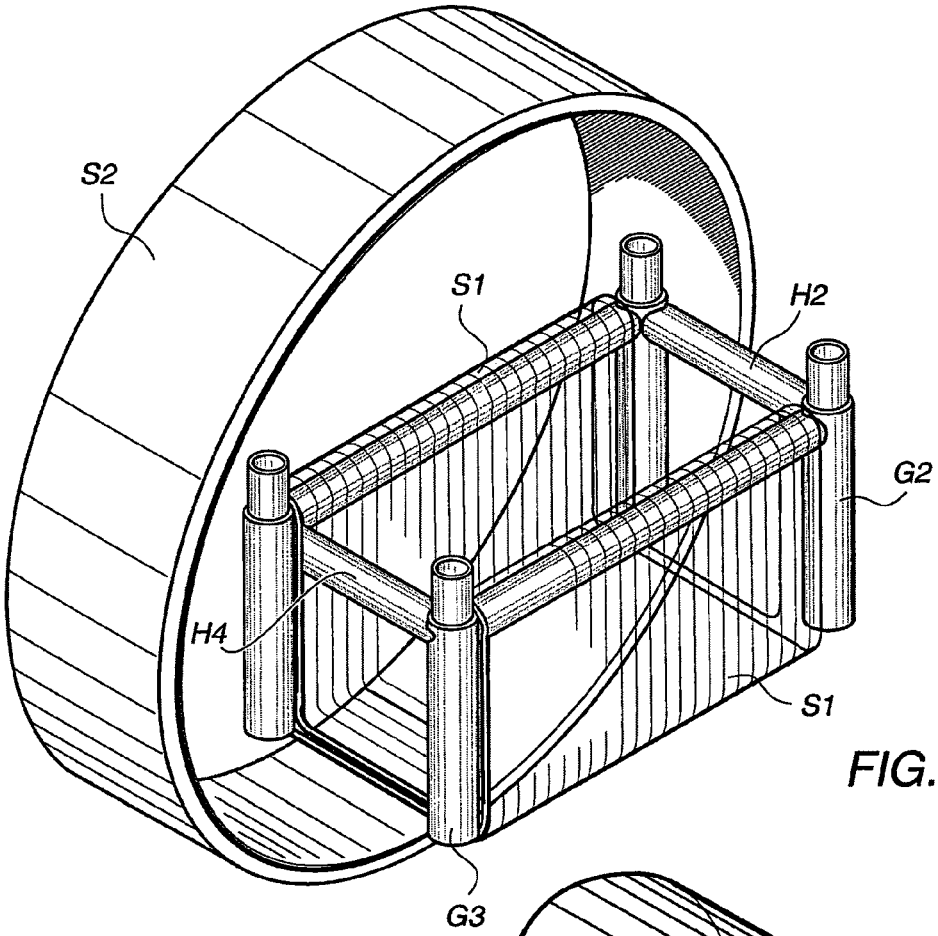
Figure 2C:
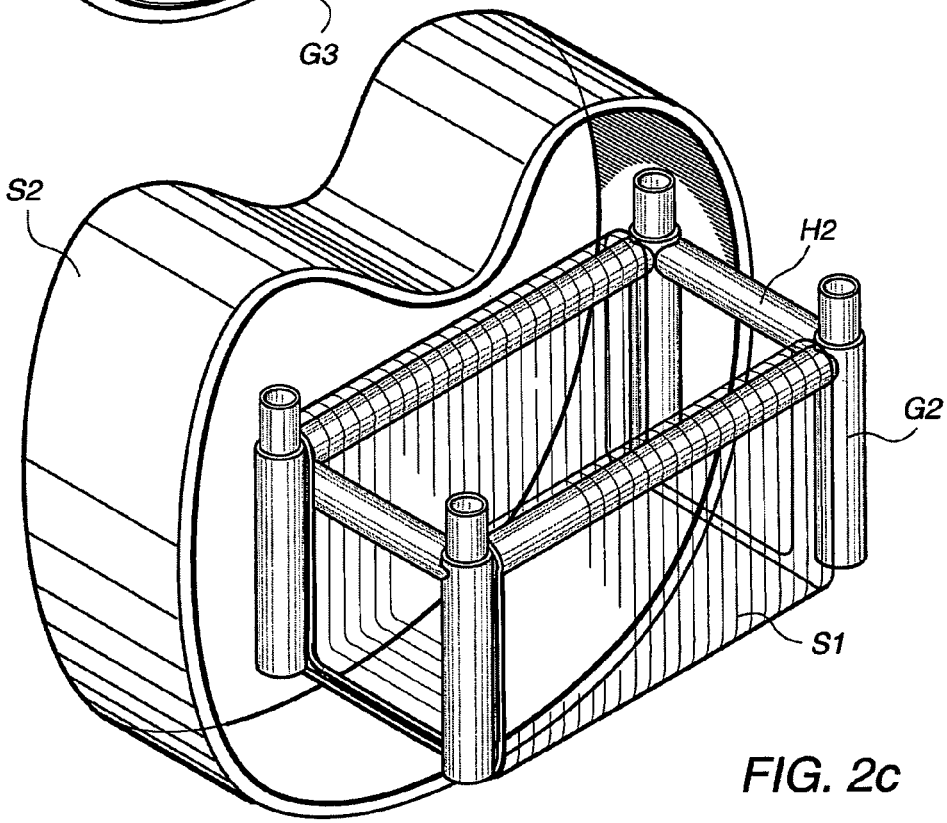

As clearly seen in the attached drawings, the container of the present invention is essentially composed of three elements: A rigid structure generally denoted F in FIG. 1*a*; a first sleeve $S_1$; and a second sleeve $S_2$ (FIG. 2*a*).

Figure 5:
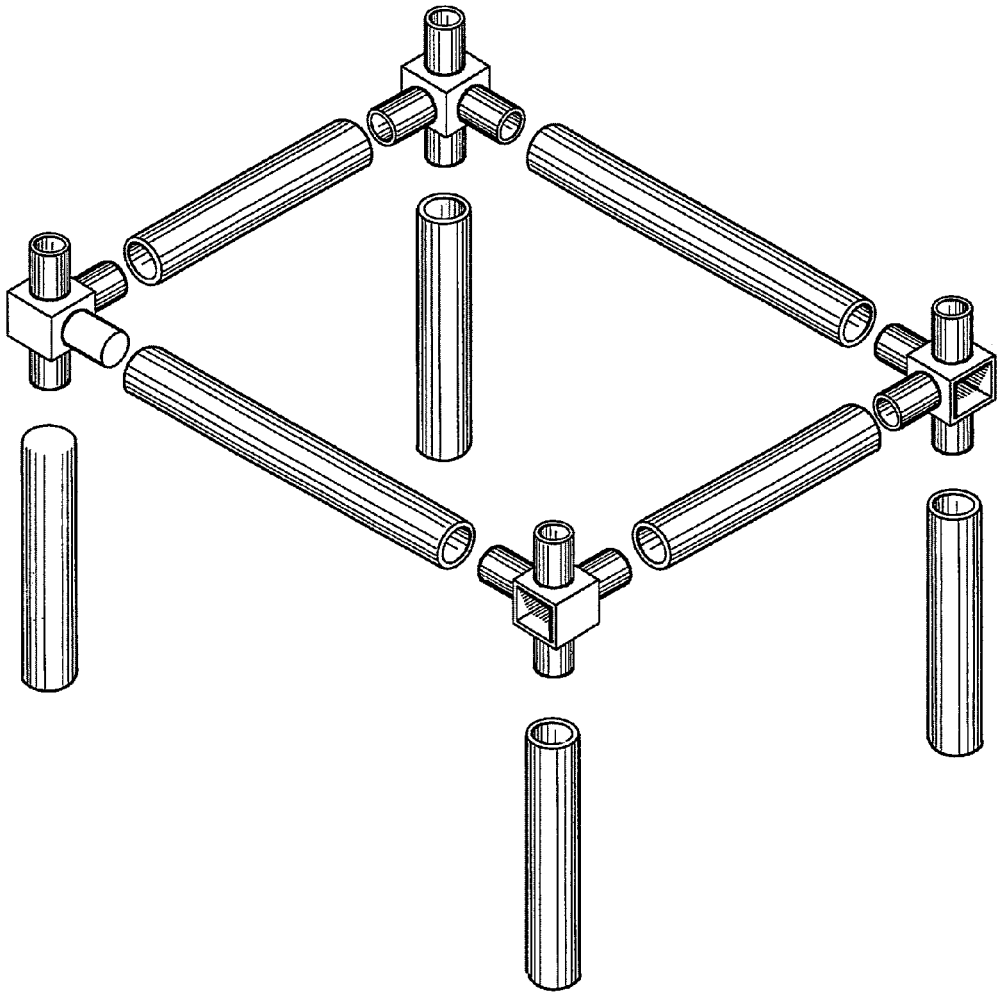
FIG. 5 illustrates a container frame composed of discrete elements ("kit")

The frame F may be produced as a solid, integrally formed body, or preferably, assembled from a kit of rods with suitable connectors as will be exemplified further below in conjunction with FIG. 5.

The frame may be made of any suitable material such as plastics, wood, metal and/or any combination thereof.

In any case, the frame F is composed of four legs $G_1$, $G_2$, $G_3$ and $G_4$, interconnected by four frame members $H_1$, $H_2$, $H_3$ and $H_4$. The frame is rectangular having lengths $L_i$ and $L_2$, and height $L_3$, conforming the measurements of standard shipment containers.

The frame legs may comprise upper sections $g_1$, $g_2$, $g_3$ and $g_4$ of a reduced diameter (or other cross-sectional shape) for stacking a plurality of frames one on top of the other.

The sleeves $S_1$ and $S_2$ are preferably made by extrusion of plastic material as conventionally known, although other sheet materials such as cloth or even paper may be used.

The length of the sleeves $S_1$ and $S_2$ equal the frame measurements $L_1$ and $L_2$, respectively.

The diameters $D_1$ and $D_2$ of the sleeves $S_1$ and $S_2$ are determined by the following formulas:

$$D_1=(4L_3+2L_2)/\pi$$

$$D_2=(4L_3+2L_1)/\pi$$

The method of assembling the frame F with the sleeves $S_1$ and $S_2$ to complete a container is vividly illustrated in the series of FIGS. 1*b*-1*e* and 2*b*-2*d*.

Figure 1B:
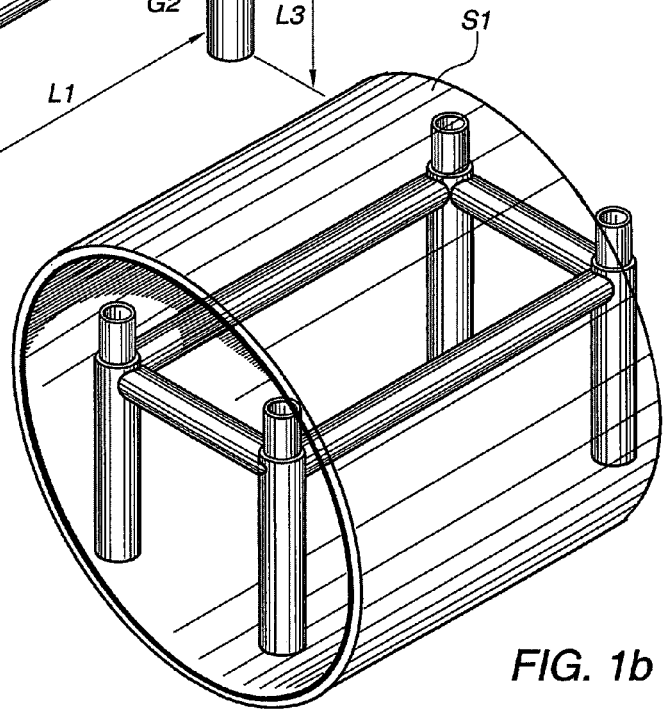
FIG. 1*b* shows a second stage of the method.
Figure 1C:
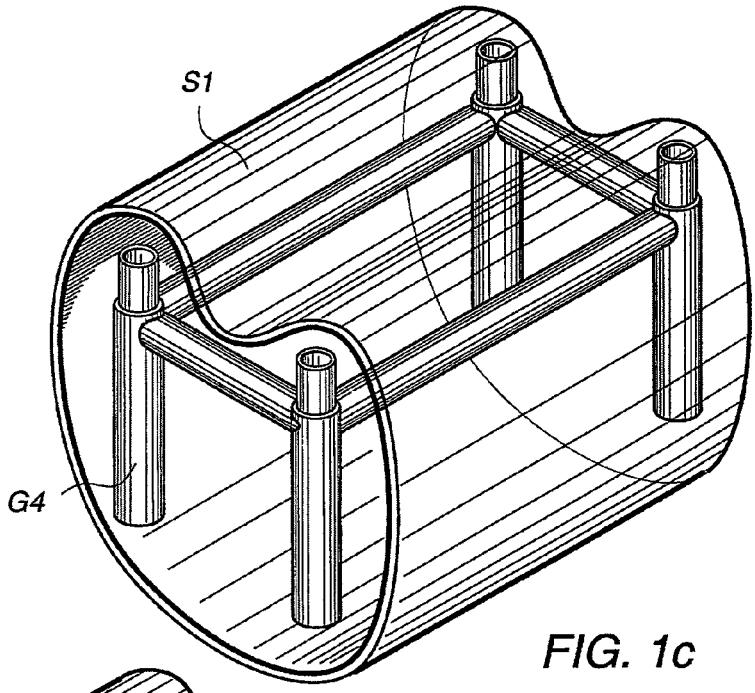
FIG. 1*c* shows a third stage.
Figure 1D:
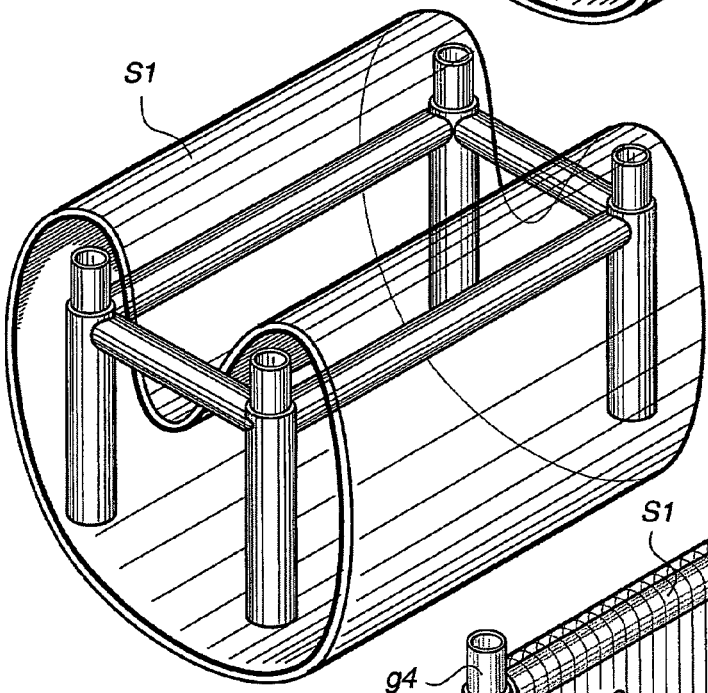
FIG. 1*d* shows a fourth stage.

Hence, the first stage of the first phase is to bring the sleeve $S_1$ over the frame F (or for that matter, insert the frame into the sleeve) as shown in FIG. 1*b*.

Figure 1E:
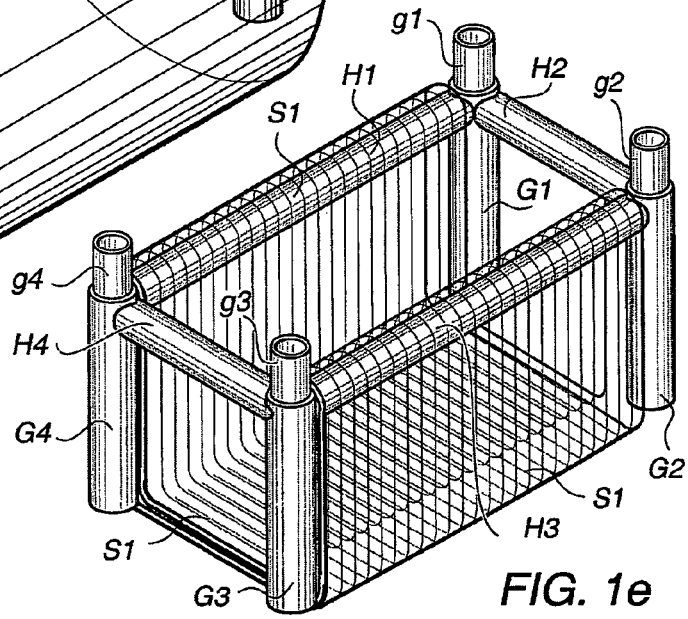
FIG. 1*e* shows the completion of the first method phase, namely dressing a first sleeve over one part of the container rigid frame structure.

In this position, the upper portion of the sleeve $S_1$, is gradually folded into the frame, namely between the frame members $H_1$ and $H_3$. At the end of this phase, double-layer, side-walls and bottom-wall are created as seen in FIG. 1*e*.

Figure 2D:
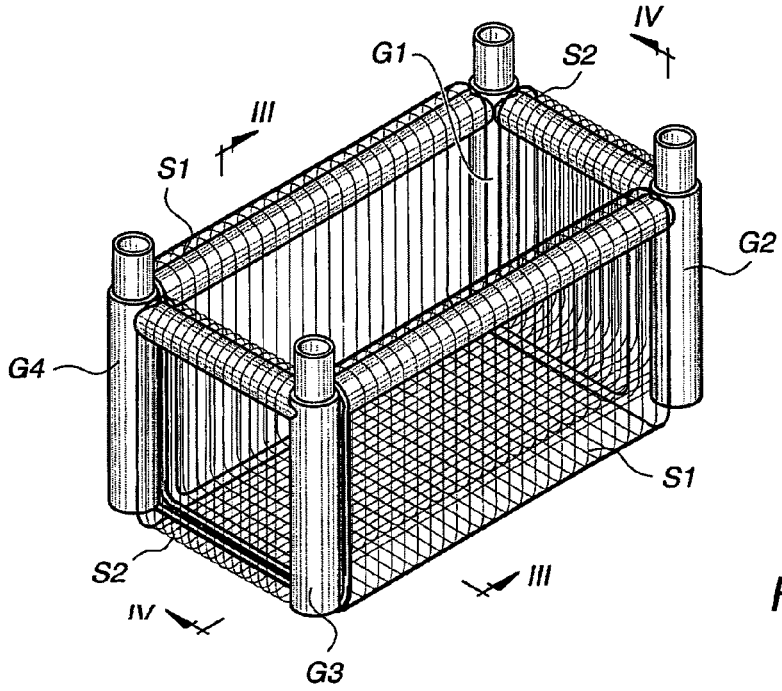
Figure 3:
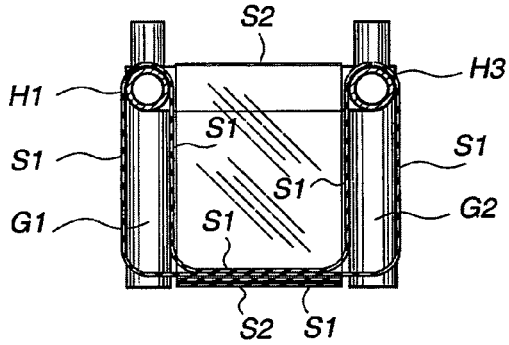
FIG. 3 is a sectional view taken along line III - III of FIG. 2*d*.
Figure 4:
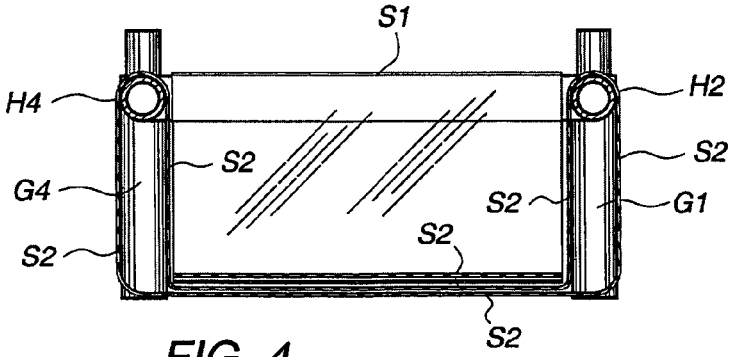
FIG. 4 is a sectional view taken along line IV -IV of FIG. 2*d*.

The second phase starts by dressing the second sleeve $S_2$ over the frame (including the folded-over sleeve $S_1$) but in a 90° rotated dissection, and repeating the folding, this time over the frame members $H_2$ and $H_4$. The result is depicted in FIG. 2*d*, namely the completion of the container assembly with two-layer side-walls and a four-layer bottom-wall: see for more clarity FIGS. 3 and 4.

It is true that since the container walls are not rigid, like any of the conventional containers, there will be a tendency thereof to bulge outwards under the weight of products loaded thereinto; however, experiments have proved that this phenomena does not interfere with the use of the containers where a bulk of relatively small-size agricultural products, such as onions, tomatoes and the like are concerned. The final prismatic shape of the container is hardly affected.

The outstanding advantages of the novel container will now be readily appreciated (some of which were already listed above). The main problem of the necessity to ship back empty containers or boxes, or to discard them (whether recycled or not) is almost completely overcome. This is particularly true when the kit form of frames is employed as seen in FIG. 5 which is self-explanatory. Note, however, that according to another option, an additional set of rods may be used at the bottom side of the container thereby enhancing the stability of the frame on the one hand and creating tension to the side- and bottom-walls, on the other hand.

Those skilled in the art to which this invention pertains will readily appreciate that numerous changes, variations and modifications can be effectuated without departing from the true spirit and scope of the invention as defined in and by the appended claims.

What is claimed is:

1. A method of producing open top containers, in particular for storing and/or shipping of agricultural products, comprising the steps of:

(a) providing a rigid structure comprised of:

(i) a horizontal rectangular frame comprised of at least four interconnected frame-members, said at least four interconnected frame members forming four sides of said rectangular frame; a first at least two frame members parallel to each other and forming at least portions of opposite sides of said rectangular frame; a second at least two frame members parallel to each other and forming at least portions of opposite sides of said rectangular frame; said second at least two frame members being perpendicular to said first at least two frame members; and (ii) four legs extending substantially vertically from the four corners of said frame;

(b) wrapping said rigid structure by a first sleeve made of foldable sheet material so that said first sleeve envelopes said first at least two frame members; and (c) wrapping said rigid structure by a second sleeve made of a foldable sheet material so that said second sleeve envelopes said second at least two frame members, said second sleeve transverse in a horizontal plane to said first sleeve, thereby providing a container with side walls and a bottom wall formed by said first sleeve and said second sleeve, said side walls comprising two layers of said foldable sheet material and said bottom wall comprising four layers of said foldable sheet material.

2. The method of claim 1 wherein the diameter ($D_1$) of said first sleeve is approximately equal to $(4L_3+2L_2)/\pi$ and the diameter ($D_2$) of said second sleeve is approximately equal to $(4L_3+2L_1)/\pi$, wherein:

$L_1$ is the length of one pair of opposite sides of said rectangle;

$L_2$ is the length of another pair of opposite sides of said rectangle; and $L_3$ is the length of said legs.

3. The method of claim 2 wherein said sleeves are made by extrusion of plastic material.

4. The method of claim 1 wherein said frame members and said legs are separable from each other.

5. An open top container, in particular for storing and/or shipping of agricultural products, comprising:

(a) a rigid structure comprised of (i) a horizontal rectangular frame comprised of at least four interconnected frame members, said at least four interconnected frame members forming four sides of said rectangular frame; a first at least two frame members parallel to each other and forming at least portions of opposite sides of said rectangular frame; a second at least two frame members parallel to each other and forming at least portions of opposite sides of said rectangular frame; said second at least two frame members being perpendicular to said first at least two frame members; and (ii) four legs extending substantially vertically from the four corners of said frame;

(b) a first sleeve made of a foldable sheet material wrapped over said first at least two frame-members; and (c) a second sleeve made of a foldable sheet material wrapped over said second at least two frame-members, said second sleeve transverse in a horizontal plane to said first sleeve wherein said first sleeve and said second sleeve form side walls and a bottom wall for said container, said side walls comprising two layers of said foldable sheet material and said bottom wall comprising four layers of said foldable sheet material.

6. The container of claim 5 wherein the diameter $D_1$ of the first sleeve is determined by the formula $D_1 \approx (4L_3+2L_2)/\pi$ and the diameter $D_2$ of the second sleeve is determined by the formula $D\ D_2 \approx (4L_3+2L_1)/\pi$, wherein $L_1$ is the length of one pair of sides of said rectangle, $L_2$ is the length of another pair of opposite sides of said rectangle, and $L_3$ is the length of said legs.

7. The container of claim 5 wherein the material of said sleeves is comprised of an extruded plastic.

8. The container of claim 5 wherein said frame members and said legs are separable from each other.

* * * * *